US006316103B1

(12) United States Patent
Stanitis et al.

(10) Patent No.: US 6,316,103 B1
(45) Date of Patent: Nov. 13, 2001

(54) BICOMPONENT FIBERS IN A SHEATH-CORE STRUCTURE COMPRISING FLUOROPOLYMERS AND METHODS OF MAKING AND USING SAME

(75) Inventors: Gary E. Stanitis, Sewell, NJ (US); Joseph P. Fagan, Plumsteadville, PA (US)

(73) Assignee: Ausimont USA, Inc., Thorofare, NJ (US)

( * ) Notice: Subject to any disclaimer, the term of this patent is extended or adjusted under 35 U.S.C. 154(b) by 0 days.

(21) Appl. No.: 09/697,607

(22) Filed: Oct. 26, 2000

Related U.S. Application Data

(6262) Division of application No. 09/147,946, filed as application No. PCT/US97/16750 on Sep. 12, 1997, now Pat. No. 6,174,601.

(60) Provisional application No. 60/025,256, filed on Sep. 13, 1996.

(51) Int. Cl.[7] ..... D01F 8/00; D01F 8/14; D01F 8/12

(52) U.S. Cl. ..... 428/370; 428/373; 264/172.15

(58) Field of Search ..... 428/370, 373; 264/172.15

(56) References Cited

U.S. PATENT DOCUMENTS

| | | |
|---|---|---|
| 4,708,080 | 11/1987 | Conrad . |
| 4,828,911 | 5/1989 | Morman . |
| 5,447,794 | 9/1995 | Lin . |

FOREIGN PATENT DOCUMENTS

| | | |
|---|---|---|
| 0 574 772 A1 | 3/1993 | (EP) . |
| 0 574 772 B1 | 3/1993 | (EP) . |
| WO 97/20974 | 6/1997 | (WO) . |

*Primary Examiner*—N. Edwards
(74) *Attorney, Agent, or Firm*—Norris, McLaughlin & Marcus

(57) ABSTRACT

The invention is directed to a sheath core fiber having a sheath of E-CTFE fluoropolymers.

16 Claims, 2 Drawing Sheets

BICOMPONENT FIBERS IN A SHEATH-CORE STRUCTURE COMPRISING FLUOROPOLYMERS AND METHODS OF MAKING AND USING SAME

CROSS-REFERENCE TO RELATED APPLICATIONS

This is a division of application Ser. No. 09/147,946, filed on Feb. 26, 1999 now U.S. Pat. No. 6,174,601 which in turn was a national stage filing of International Application No. PCT/US97/16750, filed Sep. 12, 1997, which was co-pending with and claims the benefit of U.S. Provisional Application No. 60/025,256 filed Sep. 13, 1996.

BACKGROUND OF THE INVENTION

1. Field of the Invention

The present invention relates to composite bicomponent fibers having a sheath-core structure. The advantages of the composite bicomponent fiber are achieved principally by the cooperation of the characteristics of the core component, such as high tensile strength and low cost, with the enhanced surface properties of the sheath component, particularly resistance to staining, water, chemicals, and high temperatures, along with low electrical conductivity.

2. Prior Art

Composite bicomponent sheath-core fibers and production processes therefor are known. Typically, nylon fibers, nylon 6, nylon 6,6, or copolymers thereof, are used as a core component (see for example U.S. Pat. No. 5,447,794-Lin). The sheath component is typically a variation of the same material as the core material, as shown by Lin, or a polymer such as a polyester or polyolefin (see Hoyt and Wilson European Patent Application No. 574,772). Composite, bicomponent, sheath-core fibers are generally made by delivery of the two component materials through a common spinnerette or die-plate adapted for forming such composite, bicomponent, sheath-core fibers.

Generally, composite bicomponent sheath-core fibers have been used in the manufacture of non-woven webs, wherein a subsequent heat and pressure treatment to the non-woven web causes point-to-point bonding of the sheath components within the web matrix to enhance strength or other such desirable properties in the finished web or fabric product. Other uses of composite bicomponent sheath-core fibers include the production of smaller denier filaments, using a technology generally referred to as "islands-in-the-sea", to produce velour-like woven fabrics typically used for apparel.

Such technology is typically employed in the production of relatively large diameter, monofilament, composite, bicomponent individual monofilaments are grouped into a multifilament yarn. However, the spinning of a small denier multifilament yarn bundle, e.g. less than 100 denier comprised of many (e.g. ten or more) individual sheath-core continuous filaments, is generally commercially unavailable because of the complexities associated with the process and materials used for the sheath and core components.

In order to successfully spin a small denier multifilament yarn bundle comprised of a plurality of individual, composite, bicomponent, sheath-core fibers, the limitations imposed by the known production processes and the materials used as the core and sheath components must be overcome. The demanding requirements of the final composite yarn would be met by simultaneously extruding two different materials in a common process, which requires a degree of Theological, thermal and viscoelastic similarity between the two materials. Additionally, the complexity of quality extrusion increases as the diameter of the individually extruded composite bicomponent sheath-core fibers decreases. Further, once the extruded filaments exit the spin-plate of the spinnerette or die-plate, the filaments must be drawn, typically employing an annealing process done at high speed and under tension, to align the crystal structure and develop strength in the overall composite.

A similarity in stress/strain behavior of the materials used for the core component and the sheath component is required to avoid premature overstretching and breaking (% elongation) during the drawing process. Additionally, sufficient elongation, and tensile strength (tenacity) must be achieved in the final composite yarn to withstand the physical rigors of weaving. Further, the generally thin sheath component should withstand high abrasion while maintaining its integrity and encapsulation of the core component.

The choice of materials used for the sheath-core components is limited by both the rigors of the manufacturing process and the requirements of the final composite yarn. The prior art includes at least the following combinations of materials for sheath-core fibers:

| sheath | core |
|---|---|
| polyethylene terephtalate (polyester, PET) | polyethylene (PE) |
| PET | polypropylene (PP) |
| PP | PET |
| nylon 6 | nylon 6,6 |
| PET, PP, nylon 6 | water soluble components |

The rheological and viscoelastic properties of thermoplastic fluoropolymers such as polytrifluoroethylene (PTFE), are very dissimilar to the above listed materials. Consequently few such fluoropolymers have been made as one component fibers, particularly in a multifilament format. For example, PTFE has not been known to be melt processible and has only been described as extruded in a proprietary wet spinning process wherein the PTFE latex is mixed and coextruded with a cellulosic dope.

SUMMARY OF THE INVENTION

HALAR® (ethylenemonochlorotrifluoroethylene, E-CTFE), which is supplied by Ausimont USA, Inc., possesses certain enhanced surface properties which are desirable in a sheath component. However, ordinary E-CTFE also has several properties which are adverse to its use as a sheath component. E-CTFE exhibits high viscosity in the melted state and also requires stabilization against thermal degradation by inclusion of volatile additives which may off-gas and interfere with extrusion. Standard E-CTFE also rapidly crystallizes, cools and sets before the drawing process and other necessary fiber making parameters can be applied. Experimental composite bicomponent sheath-core fibers made with standard E-CTFE as a sheath component typically have exhibited low elongation capability, exhibit fracture even when not under tension, and exhibit discontinuities in the sheath component and strength too low to successfully weave into a fabric comprised of small denier yarn bundles.

While different ones of the prior composite bicomponent sheath-core fibers have certain desirable properties, there has been a continuing need and a desire in the art to develop a bicomponent sheath-core fiber having a material such as E-CTFE as the sheath component, while possessing the advantages of the cooperation of the desirable characteristics of a strong core component and the enhanced surface properties of a sheath component.

Accordingly, it is an object of the present invention to provide an E-CTFE coating (sheath) material which overcomes the physical and manufacturing disadvantages of prior E-CTFE components when used as the sheath component in a composite, bicomponent sheath-core fiber.

It is another object of the present invention to provide a composite bicomponent fiber having a sheath-core structure where the core component is any spinnable polymer with fiber properties similar to nylon 6, nylon 6,6, polyethylene terephtalate and copolymers thereof and a sheath component of the fluoroploymer ethylenemonochlorotrifluoroethylene having a range of volume crystallinity between about 10% and 49%, and extending at the lower end of the range to about 1%.

It is another object of the present invention to provide composite bicomponent fiber having a sheath-core structure where the sheath component is ethylenemonochlorotrifluoroethylene having a non 1:1 molar ratio of ethylene to monochlorotrifluoroethylene.

It is another object of the present invention to provide composite bicomponent fiber having a sheath-core structure where the sheath component is ethylenemonochlorotrifluoroethylene having a volume crystallinity between about 20% and 30%.

It is another object of the present invention to provide a composite, bicomponent, sheath-core fiber using E-CTFE as the sheath component which ensures better utilization of the properties of the sheath-core bicomponent fiber without deterioration in the properties of the sheath component.

It is another object of the present invention to provide new and better performing, small denier continuous yarns comprised of a plurality of sheath-core fibers having E-CTFE as the sheath component without a deterioration of the properties of the yarns.

It is another object of the present invention to provide a process for producing such an E-CTFE component and a composite, bicomponent sheath-core fiber and a process for producing such a yarn.

In accordance with one aspect of the present invention, a method of producing composite bicomponent fiber having a sheath-core structure includes the steps of formulating ethylenemonochlorotrifluoroethylene having a low volume crystallinity by the alteration of the molar ratio of ethylene and monochlorotrifluoroethylene or by the addition of another fluoropolymer monomer, and feeding a core component of any spinnable polymer with fiber properties similar to nylon 6, nylon 6,6, polyethylene terephtalate and copolymers thereof, and sheath components via a first spinnerette plate to a second spinnerette plate in a plurality of individual streams and, between the first and second spinnerette plates each individual stream of core material is enveloped by the sheath material being fed onto the core component, the two components being commonly spun, drawn and wound.

DESCRIPTION OF THE DRAWINGS

Referring to FIG. 1, composite bicomponent fibers having a sheath-core structure of this invention are produced by a process wherein a core component and sheath component are measured and extruded by means of their respective metering pump drive 9, 11, metering pump 10, 12, and extruder 1, 2 and are fed via a first spinnerette plate to a second spinnerette plate contained within a spinnerette pack 3, wherein each individual stream of core component is enveloped by the sheath component being fed into it. The resulting sheath-core filaments pass through a quench cabinet 13 where a cooling gas is blown past the filaments. The two components pass over a finish roll 4, are taken up on godet cans 5,6,7 and winder 8. The rate of revolution of the godet cans determines the wind up speed. Typically, the godet cans run at approximately the same rate. The foregoing equipment is generally conventional for making sheath-core filaments.

Referring to FIG. 2, godet cans 15, 16, and 17 are run at different speeds in a drawing process. Can 16 runs faster than can 15, and can 17 runs faster than can 16. The ratio of the speed of can 17 to can 15 is the draw ratio, typically around 3 to 5. Cans 15, 16, and 17 typically are heated to make the component materials draw more easily and to a greater extent, with the temperature determined by the type of components used. Generally, cans 15 and 16 are heated to near the glass transition of the component materials.

DESCRIPTION OF THE PREFERRED EMBODIMENT

Figure 1:
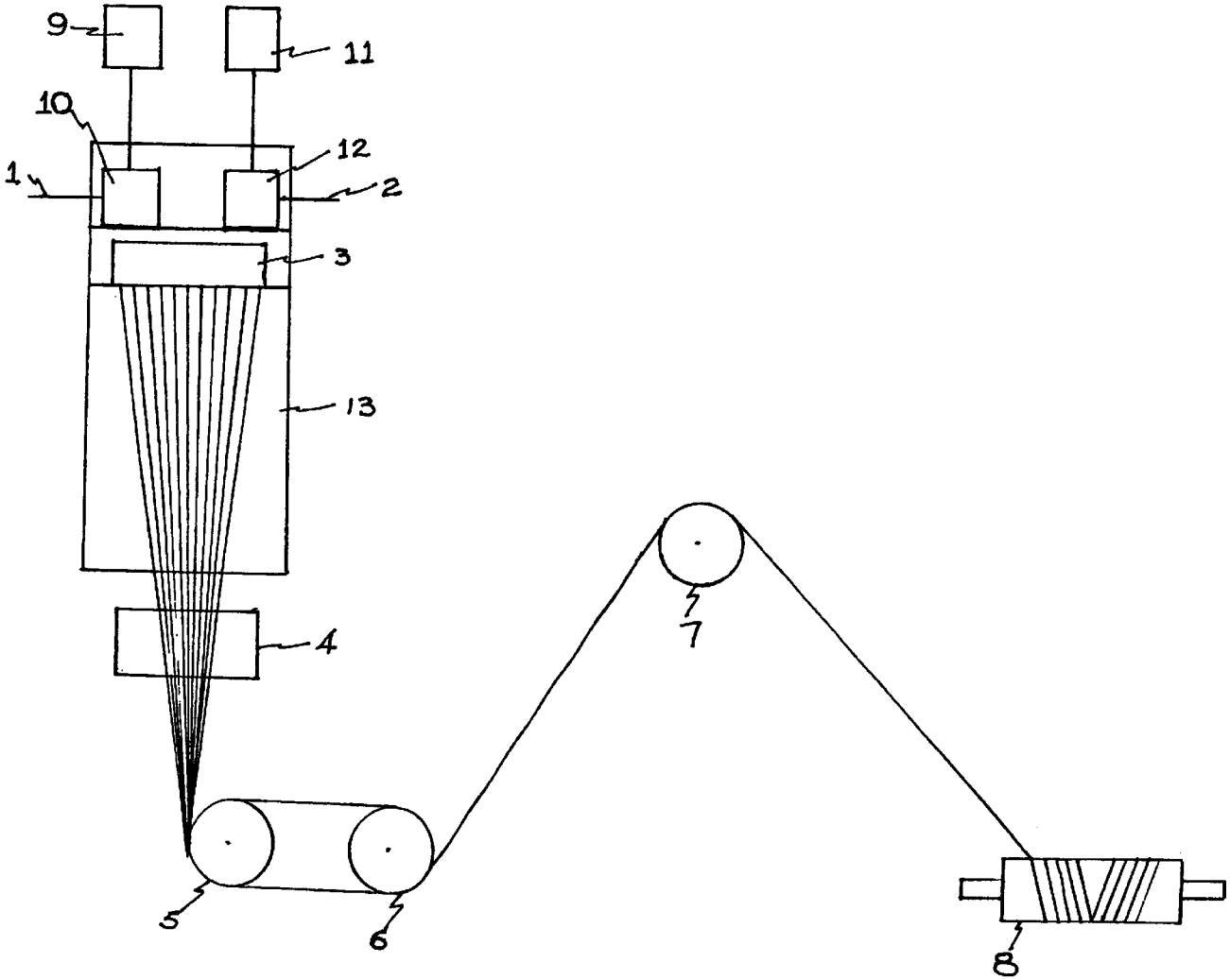
FIG. 1 and FIG. 2 are schematic representations of a process for melt spinning composite bicomponent fibers suitable to make the sheath-core filaments of this invention.
Figure 2:
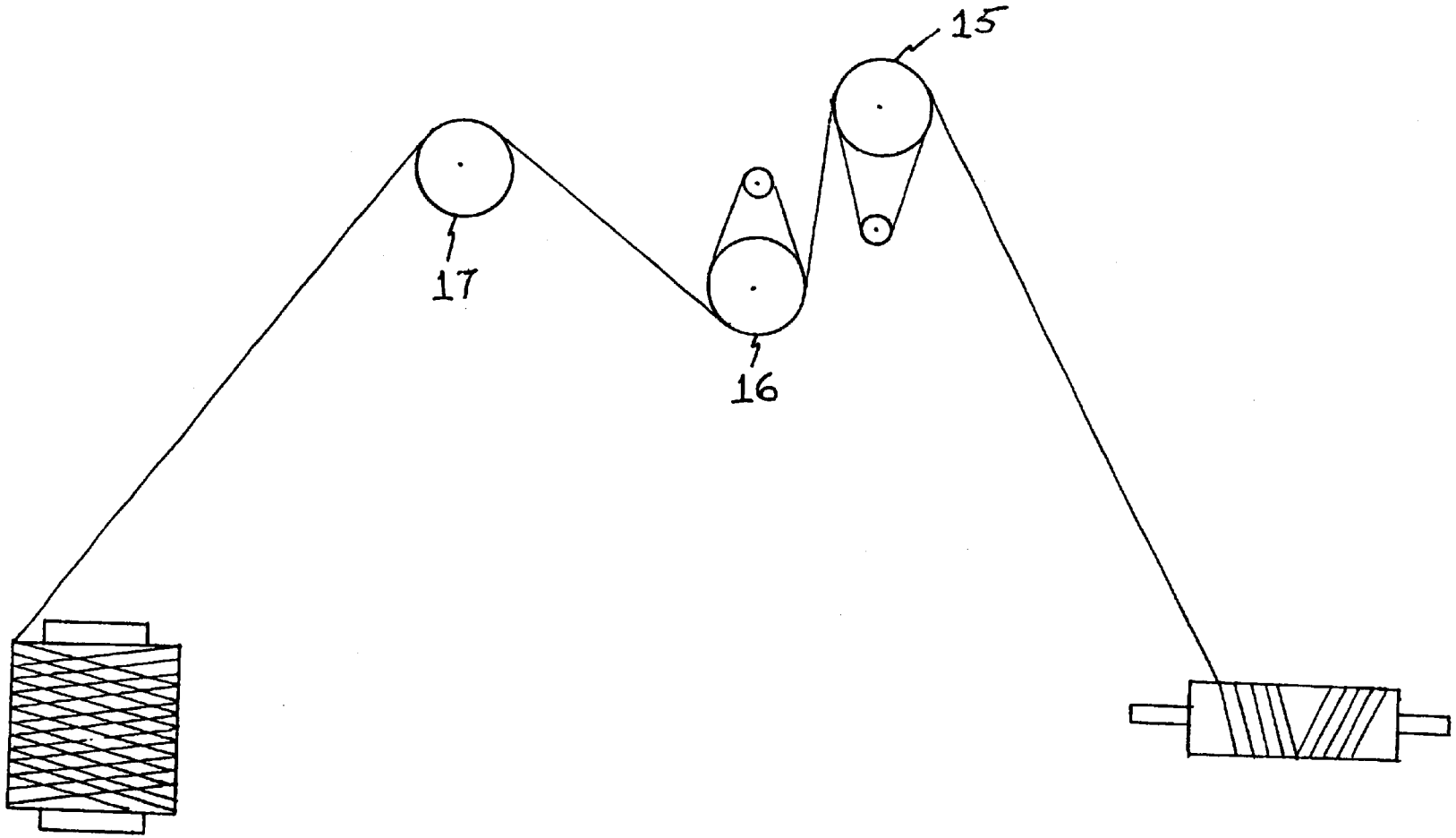

Table 1 shows, in the first line thereof, the results of making and testing a composite bicomponent sheath-core fiber having an inner nylon core and an outer sheath of a 50:50 molar ratio of E-CTFE (Standard E-CTFE). The resulting fiber was tested and examined and was found to exhibit undesirable characteristics as listed and as explained above. It was subsequently discovered that, by adjusting the molar ratio of CTFE and ethylene to a 55:45 molar ratio E-CTFE (CTFE-rich E-CTFE) for the sheath component, a particularly advantageous and useful result was unexpectedly obtained. Thus, as indicated in the succeeding lines of data shown in Table 1, for two different core filaments (PET and Nylon 6) having a coating thickness of the CTFE-rich E-CTFE polymer between 1% to 99% by weight of the finished fiber with 10% to 50% by weight being preferred, a strong, compatible, continuous sheath fiber was obtained which is suitable for making continuous fine denier fiber. Lower crystallinity at the present time is attributed to be a factor in the desired results obtained. The CTFE-rich E-CTFE has less volume crystallinity, a lower melting point allowing for faster quenching and greater undrawn elongation than the bicomponent fiber utilizing Standard E-CTFE as the sheath component. A lower volume crystallinity E-CTFE is achieved by making E-CTFE rich in one monomer, CTFE. Another method to lower crystallinity is the inclusion of an additional monomer in E-CTFE. The additional monomer is selected from those copolymerizable olefinic fluorinated and non-fluorinated monomers which when incorporated into E-CTFE will reduce the crystallinity.

The lower volume crystallinity sheath-core fiber E-CTFE can be drawn more than such sheath-core fiber utilizing Standard E-CTFE without the sheath cracking. The greater draw allows the core material to develop superior strength (drawn tenacity) and extension after drawing (drawn elong. at break), desired properties for easy weaving and use in continuous yarns. While the modified E-CTFE with 55:45 molar ratio was successful, it is anticipated that other similar ratios in the vicinity of that ratio also may be expected to exhibit similar desirable and advantageous characteristics in such applications. E-CTFE with such desired and advantageous characteristics can also be obtained by incorporation of appropriate modifying monomer during polymerization.

While the various aspects of the present invention have been described in terms of preferred embodiments, it will readily be apparent to persons skilled in this art that various modifications may be made without departing from the scope of the invention which is set forth in the following claims.

TABLE 1

| CTFE Ethylene Molar Ratio | Melting Point, C. | (1) Volume % Crystalinity | Core Material | Sheath Core Ratio | Wind up Speed (m/min) | (2) Undrawn Total Denier | Undrawn Elong at Break % | Undrawn Tenacity/ (gm/denier) | Draw Ratio | Drawn Denier/ Filament | (6) Drawn Elong. at Sheath Break % | Drawn Tenacity (gm/denier) | Sheath Continuity |
|---|---|---|---|---|---|---|---|---|---|---|---|---|---|
| 50:50 | 240 | 50 | Nylon 6 | 50/50 | 500 | | 40–60 | 0–7 | 4.0 | 7 | 0(7) | 1.99 | No (3, 4, 5) |
| 55.45 | 207 | 20 to 30 | PET | 50/50 | 150 | 12,441 | 250 | | 4.0 | 9.8 | | 2.0 | Yes (4) |
| 55.45 | 207 | 20 to 30 | PET | 50/50 | 2000 | 2,190 | 35 | 0.7 | 2.0 | 2.0 | 15 | 2.4 | Yes (4) |
| 55.45 | 207 | 20 to 30 | PET | 50/50 | 1000 | 1,166 | 300 | 0.8 | 3.0 | 1.2 | 20 | 2.9 | Yes (4) |
| 55.45 | 207 | 20 to 30 | PET | 50/50 | 1000 | 1,166 | 150 | | 3.0 | 1.2 | 18 | 3.1 | Yes (4, 5) |
| 55.45 | 207 | 20 to 30 | Nylon 6 | 40/60 | 1000 | 1,166 | 250 | 0.9 | 3.0 | 1.1 | 15 | 3.7 | Yes (3, 4, 5) |
| 55.45 | 207 | 20 to 30 | Nylon 6 | 45/60 | 1000 | 1,166 | 200 | 0.7 | 2.5 | 2.0 | 50 | 2.7 | Yes (3, 4) |

(1) Approximate, based on heats of melting determined by differential scanning calorimeter
(2) All tests were done with a 288 hole spinnerette.
(3) A one meter length of composite yarn was placed into a heated solution of material known to be strong dyestuff for nylon and polyester. Only the "cross-section" ends of the filament bundles were not exposed to the solution. The dye solution was agitated for approx. 30 minutes and the yarn was then removed and thoroughly rinsed with water. The yarn was then examined against a white background for observance of color.
(4) At the wind-up position wherein the package of accumulating yarn is being wound at very high speed, a minor break in the sheath covering would give the "package, or cone" the visual appearance of "grayness" during the winding and one could actually "feel" the wisp-like broken sheath component "whipping" against the skin if the hand was placed in very close contact with the accumulating, moving package.
(5) Scanning Electron Microscope photographs at very high magnification (200× to 1000×) were taken of both the cross-section of the bi-component yarn as well as along the length of the bicomponent yarn. Thus, one could readily examine the integrity of the sheath covering for splits, cracks or voids.
(6) The point of breakage was determined by when the first sheaths were observed to break.
(7) Significant numbers of sheaths were already broken during the drawing process. No additional elongation was possible.

What is claimed is:

1. A sheath-core bicomponent fiber comprising:

a core component of a first spinnable polymer material, said first polymer material being selected from the group consisting of polyethylene, polyester, polypropylene, polyolefin and copolymers thereof; and a sheath component of a second polymer material said second polymer material being selected from the group consisting of a co-polymer of at least ethylene and chlorotrifluoroethylene wherein said co-polymer of ethylene and chlorotrifluoroethylene has a non 1:1 molar ratio of ethylene to chlorotrifluoroethylene and a volume crystallinity between about 1% and 49%.

2. A sheath-core bicomponent fiber according to claim 1 wherein said sheath component has a volume crystallinity between about 10% and 49%.

3. A sheath-core bicomponent fiber according to claim 1 wherein said sheath component has a volume crystallinity between about 20% and 30%.

4. A sheath core bicomponent fiber according to claim 1 wherein the molar ratio of chlorotrifluoroethylene to ethylene is about 55:45.

5. A sheath-core bicomponent fiber according to claim 2 wherein said co-polymerizable olefinic monomer is a fluorinated monomer.

6. A process for forming sheath-core bicomponent fibers of claim 1 suitable for spinning of multifilament yarn bundles of less than 100 denier comprising:

feeding a core component via a first spinnerette plate to a second spinnerette plate in a plurality of individual streams;

enveloping each individual stream of core component in a region between said first and second spinnerette plates with a sheath component fed onto said core component;

feeding composite sheath-core elements through said second spinnerette plate to provide individual sheath-core filaments; and spinning, drawing and winding up the composite sheath-core filament output of said second spinnerette plate, characterized in that;

said core component is selected from the group consisting of polyethylene, polyester, polypropylene and co-polymers thereof; and said sheath component is selected from the group consisting of a co-polymer of at least ethylene and chlorotrifluoroethylene.

7. A process according to claim 6 for forming sheath-core bicomponent fibers suitable for spinning of multifilament yarn bundles of less than 100 denier wherein said sheath component has a volume crystallinity between about 10% and 49%.

8. A process according to claim 6 for forming sheath-core bicomponent fibers suitable for spinning of multifilament yarn bundles of less than 100 denier wherein said sheath component has a volume crystallinity between about 1% and 49%.

9. A process according to claim 6 for forming sheath-core bicomponent fibers suitable for spinning of multifilament yarn bundles of less than 100 denier wherein said sheath component has a volume crystallinity between about 20% and 30%.

10. A process according to claim 6 for forming sheath-core bicomponent fibers suitable for spinning of multifilament yarn bundles of less than 100 denier wherein said copolymer of ethylene and chlorotrifluoroethylene has a non 1:1 molar ratio.

11. A process according to claim 6 for forming sheath-core bicomponent fibers suitable for spinning of multifilament yarn bundles of less than 100 denier wherein the molar ratio of chlorotrifluoroethylene to ethylene is approximately 55:45.

12. A process according to claim 7 for forming sheath-core bicomponent fibers suitable for spinning of multifilament yarn bundles of less than 100 denier wherein said co-polymerizable olefinic monomer is a fluorinated monomer.

13. The sheath-core bicomponent fiber according to claim 1 wherein said polyolefin is selected from the group consisting of polyethylene, polypropylene or combinations thereof.

14. A sheath-core bicomponent fiber comprising:

a core component of a first spinnable polymer material, said first polymer material being selected from the group consisting of polyethylene, polyester, polypropylene, polyolefin and copolymers thereof; and a sheath component of a second polymer material being a co-polymer of ethylene and chlorotrifluoroethylene and co-polymerizable olefinic monomers for reducing crystallinity of said sheath component wherein said sheath component has a volume crystallinity between about 1% and 49%.

15. The sheath-core bicomponent fiber according to claim 14 wherein said olefinic monomers are fluorinated monomers.

16. The sheath-core bicomponent fiber according to claim 14 wherein said sheath component has a volume crystallinity between about 20% and 30%.

* * * * *